US010540921B2

(12) United States Patent
Selan

(10) Patent No.: US 10,540,921 B2
(45) **Date of Patent: *Jan. 21, 2020**

(54) SYSTEMS AND METHODS FOR DETECTION AND/OR CORRECTION OF PIXEL LUMINOSITY AND/OR CHROMINANCE RESPONSE VARIATION IN DISPLAYS

(71) Applicant: Valve Corporation, Bellevue, WA (US)

(72) Inventor: Jeremy Selan, Kirkland, WA (US)

(73) Assignee: Valve Corporation, Bellevue, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/277,693

(22) Filed: Feb. 15, 2019

(65) Prior Publication Data

US 2019/0180668 A1 Jun. 13, 2019

Related U.S. Application Data

(63) Continuation of application No. 15/239,982, filed on Aug. 18, 2016.

(60) Provisional application No. 62/207,091, filed on Aug. 19, 2015.

(51) Int. Cl.
*G09G 3/20* (2006.01)

(52) U.S. Cl.
CPC ... *G09G 3/2003* (2013.01); *G09G 2320/0233* (2013.01); *G09G 2320/0242* (2013.01); *G09G 2320/0693* (2013.01); *G09G 2360/147* (2013.01)

(58) Field of Classification Search
None
See application file for complete search history.

(56) References Cited

U.S. PATENT DOCUMENTS

2003/0059101 A1 3/2003 Safaee-Rad et al.
2006/0262147 A1 11/2006 Kimpe et al.
(Continued)

FOREIGN PATENT DOCUMENTS

JP 2015-125243 A 7/2015

OTHER PUBLICATIONS

International Search Report, dated Oct. 24, 2016, for International Application No. PCT/US2016/047470, 9 page.
(Continued)

*Primary Examiner* — Nurun N Flora
(74) *Attorney, Agent, or Firm* — Seed Intellectual Property Law Group LLP

(57) ABSTRACT

Methods and systems are disclosed for measuring pixel-by-pixel luminosity and/or chrominance variations on a display, encoding and/or storing the measurements as a set of global and/or pixel-by-pixel correction factors, and/or digitally manipulating imagery with the inverse effect as the measured variations, such that the appearance of visual artifacts caused by the variations is reduced. These methods and systems may be used, for example, as part of the production process for virtual reality headsets, as well as in other applications that make high-fidelity use of displays exhibiting such artifacts (e.g., cell phones, watches, augmented reality displays, and the like).

15 Claims, 11 Drawing Sheets

(56) References Cited

U.S. PATENT DOCUMENTS

| | | | | |
|---|---|---|---|---|
| 2011/0227964 | A1* | 9/2011 | Chaji | G09G 3/006 345/690 |
| 2011/0305391 | A1 | 12/2011 | Kunkel et al. | |
| 2013/0106923 | A1 | 5/2013 | Shields et al. | |
| 2014/0049571 | A1 | 2/2014 | Erinjippurath et al. | |
| 2015/0348505 | A1* | 12/2015 | Pyo | G09G 5/10 345/589 |
| 2015/0371579 | A1 | 12/2015 | Yu et al. | |
| 2016/0133223 | A1* | 5/2016 | Kim | G09G 3/20 345/211 |

OTHER PUBLICATIONS

Japanese Office Action, dated Mar. 14, 2019, for Japanese Application No. 2018-507716, 3 pages (with English translation).
Extended European Search Report, dated Mar. 14, 2019, for European Application No. 16837801.6-1209, 7 pages.

* cited by examiner

900

SYSTEMS AND METHODS FOR DETECTION AND/OR CORRECTION OF PIXEL LUMINOSITY AND/OR CHROMINANCE RESPONSE VARIATION IN DISPLAYS

BACKGROUND

Technical Field

The disclosure relates generally to video display technology, and more specifically to systems and methods for measuring pixel-by-pixel energy emission variations on a display, encoding and storing these measurements as a set of global and per-pixel correction factors, and/or digitally manipulating imagery with the inverse effect as the measured variations, such that the appearance of artifacts caused by such variations is reduced.

Description of the Related Art

Certain display technologies exhibit luminosity and/or colorimetric (gamma) energy emission responses which vary from pixel to pixel. Such variations are sometimes referred to as "mura defects," "mura variations," or simply "mura," although the terminology and its precise meaning is not known to be standardized in the display industry.

For example, on Liquid Crystal Displays ("LCDs"), the backlight may exhibit spatial variations across the display which are visible to users. As another example, on Organic Light Emitting Diode ("OLED") displays, adjacent pixels may exhibit substantially different color responses. These effects are particularly noticeable in regions of constant color and smooth gradients, where the region may appear "noisy" to an observer. This artifact is particularly objectionable on head mounted displays ("HMDs"), sometimes appearing as a "dirty window" through which the viewer is looking.

Various subjective/manual and objective/photoelectronic methods (sometimes generally known as "mura correction" techniques) are known in the art to address these variations to various extents. However, it is desirable to address the current limitations in this art according to aspects of the present invention.

BRIEF DESCRIPTION OF THE SEVERAL VIEWS OF THE DRAWINGS

By way of example, reference will now be made to the accompanying drawings, which are not to scale.

DETAILED DESCRIPTION

Those of ordinary skill in the art will realize that the following description of the present invention is illustrative only and not in any way limiting. Other embodiments of the invention will readily suggest themselves to such skilled persons, having the benefit of this disclosure, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. Reference will now be made in detail to specific implementations of the present invention as illustrated in the accompanying drawings. The same reference numbers will be used throughout the drawings and the following description to refer to the same or like parts.

The data structures and code described in this detailed description are typically stored on a computer readable storage medium, which may be any device or medium that can store code and/or data for use by a computer system. This includes, but is not limited to, magnetic and optical storage devices such as disk drives, magnetic tape, CDs (compact discs) and DVDs (digital versatile discs or digital video discs), and computer instruction signals embodied in a transmission medium (with or without a carrier wave upon which the signals are modulated). For example, the transmission medium may include a communications network, such as the Internet.

Figure 1:
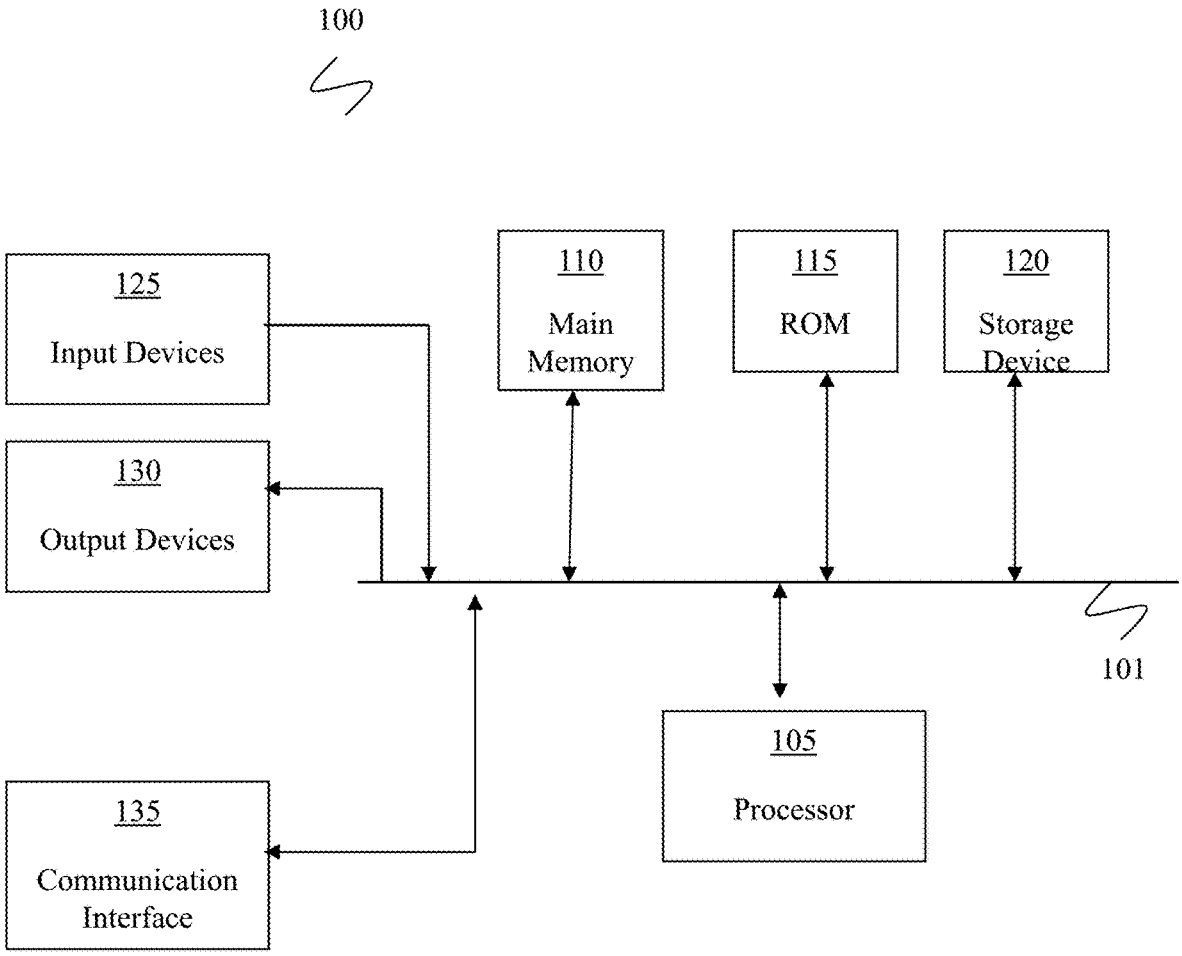
FIG. 1 is an exemplary diagram of a computing device that may be used to implement aspects of certain embodiments of the present invention.

FIG. 1 is an exemplary diagram of a computing device 100 that may be used to implement aspects of certain embodiments of the present invention. Computing device 100 may include a bus 101, one or more processors 105, a main memory 110, a read-only memory (ROM) 115, a storage device 120, one or more input devices 125, one or more output devices 130, and a communication interface 135. Bus 101 may include one or more conductors that permit communication among the components of computing device 100. Processor 105 may include any type of conventional processor, microprocessor, or processing logic that interprets and executes instructions. Main memory 110 may include a random-access memory (RAM) or another type of dynamic storage device that stores information and instructions for execution by processor 105. ROM 115 may include a conventional ROM device or another type of static storage device that stores static information and instructions for use by processor 105. Storage device 120 may include a magnetic and/or optical recording medium and its corresponding drive. Input device(s) 125 may include one or more conventional mechanisms that permit a user to input information to computing device 100, such as a keyboard, a mouse, a pen, a stylus, handwriting recognition, voice recognition, biometric mechanisms, and the like. Output device(s) 130 may include one or more conventional mechanisms that output information to the user, including a display, a projector, an A/V receiver, a printer, a speaker, and the like. Communication interface 135 may include any transceiver-like mechanism that enables computing device/server 100 to communicate with other devices and/or systems. Computing device 100 may perform operations based on software instructions that may be read into memory 110 from another computer-readable medium, such as data storage device 120, or from another device via communication interface 135. The software instructions contained in memory 110 cause processor 105 to perform processes that will be described later. Alternatively, hard-wired circuitry may be used in place of or in combination with software instructions to implement processes consistent with the present invention. Thus, various implementations are not limited to any specific combination of hardware circuitry and software.

In certain embodiments, memory 110 may include without limitation high-speed random access memory, such as DRAM, SRAM, DDR RAM or other random access solid state memory devices; and may include without limitation non-volatile memory, such as one or more magnetic disk storage devices, optical disk storage devices, flash memory devices, or other non-volatile solid state storage devices. Memory 110 may optionally include one or more storage devices remotely located from the processor(s) 105. Memory 110, or one or more of the storage devices (e.g., one or more non-volatile storage devices) in memory 110, may include a computer readable storage medium. In certain embodiments, memory 110 or the computer readable storage medium of memory 110 may store one or more of the following programs, modules and data structures: an operating system that includes procedures for handling various basic system services and for performing hardware dependent tasks; a network communication module that is used for connecting computing device 110 to other computers via the one or more communication network interfaces and one or more communication networks, such as the Internet, other wide area networks, local area networks, metropolitan area networks, and so on; a client application that may permit a user to interact with computing device 100.

Certain text and/or figures in this specification may refer to or describe flow charts illustrating methods and systems. It will be understood that each block of these flow charts, and combinations of blocks in these flow charts, may be implemented by computer program instructions. These computer program instructions may be loaded onto a computer or other programmable apparatus to produce a machine, such that the instructions that execute on the computer or other programmable apparatus create structures for implementing the functions specified in the flow chart block or blocks. These computer program instructions may also be stored in computer-readable memory that can direct a computer or other programmable apparatus to function in a particular manner, such that the instructions stored in computer-readable memory produce an article of manufacture including instruction structures that implement the function specified in the flow chart block or blocks. The computer program instructions may also be loaded onto a computer or other programmable apparatus to cause a series of operational steps to be performed on the computer or other programmable apparatus to produce a computer-implemented process such that the instructions that execute on the computer or other programmable apparatus provide steps for implementing the functions specified in the flow chart block or blocks.

Accordingly, blocks of the flow charts support combinations of structures for performing the specified functions and combinations of steps for performing the specified functions. It will also be understood that each block of the flow charts, and combinations of blocks in the flow charts, can be implemented by special purpose hardware-based computer systems that perform the specified functions or steps, or combinations of special purpose hardware and computer instructions.

For example, any number of computer programming languages, such as C, C++, C# (C Sharp), Perl, Ada, Python, Pascal, SmallTalk, FORTRAN, assembly language, and the like, may be used to implement aspects of the present invention. Further, various programming approaches such as procedural, object-oriented or artificial intelligence techniques may be employed, depending on the requirements of each particular implementation. Compiler programs and/or virtual machine programs executed by computer systems generally translate higher level programming languages to generate sets of machine instructions that may be executed by one or more processors to perform a programmed function or set of functions.

In the descriptions set forth herein, certain embodiments are described in terms of particular data structures, preferred and optional enforcements, preferred control flows, and examples. Other and further application of the described methods, as would be understood after review of this application by those with ordinary skill in the art, are within the scope of the invention.

The term "machine-readable medium" should be understood to include any structure that participates in providing data that may be read by an element of a computer system. Such a medium may take many forms, including but not limited to, non-volatile media, volatile media, and transmission media. Non-volatile media include, for example, optical or magnetic disks and other persistent memory such as devices based on flash memory (such as solid-state drives, or SSDs). Volatile media include dynamic random access memory (DRAM) and/or static random access memory (SRAM). Transmission media include cables, wires, and fibers, including the wires that comprise a system bus coupled to a processor. Common forms of machine-readable media include, for example and without limitation, a floppy disk, a flexible disk, a hard disk, a solid-state drive, a magnetic tape, any other magnetic medium, a CD-ROM, a DVD, or any other optical medium.

In certain embodiments, methods according to aspects of the present invention comprise three steps (each step is described in more detail after the following introductory list):

1) A technique for display measuring: This approach requires accurate estimation of the energy emitted for each sub-pixel of the display. The specific images captured are targeted to the known deficiencies of the display technology in conjunction with the correction model being utilized.

2) A technique for applying measurement: For each display panel, based on the appropriate correction model, a set of global and per-pixel correction factors are computed. Two general approaches to computing the correction factors are described, although combinations and/or variations of these may be implemented without departing from the scope of the invention: an iterative approach, and a non-iterative approach.

3) Real-time imagery processing: Images are processed in real-time, using the correction factors computed in the second step, above, to reduce the appearance of the visual artifacts caused by the measured pixel-by-pixel energy emission variations from step one, above.

Display Measurement

Due to the typically high number of sub-pixel elements in a display (usually more than a million), generating accurate energy estimates for each sub-pixel may comprise a relatively complex task.

In certain embodiments, step one is to image each color channel individually (e.g., red, green, blue) to reduce the number of emissive elements being imaged.

Super-sampling the panel under test using the imaging sensor is also required in certain embodiments, as an exact sub-pixel alignment between camera sensor elements and emissive display elements is typically impossible. One factor that makes such a 1:1 sub-pixel measurement typically impossible is that camera technologies typically use rectangular raster and Bayer patterns for color reproduction, while display panels often use alternative (e.g., non-rectangular) patterns such as a pentile mappings.

In certain embodiments, it has been observed that accurate display measurements can be created by using twenty-five or more photosites on the camera sensor for each sub-pixel in the display. Additional camera photosites per sub-pixel yield better results in certain embodiments.

Figure 2A:
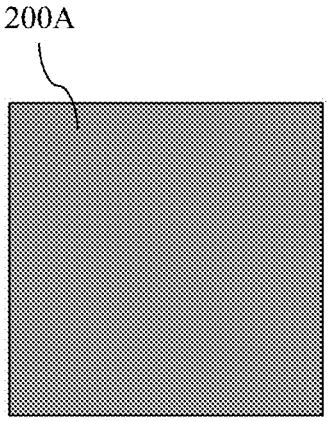
FIG. 2A is a grayscale version of a photograph depicting an exemplary all-green raw image sent to a display.

FIG. 2A is a grayscale version of a photograph (200A) depicting an exemplary all-green raw image sent to a display.

Figure 2B:
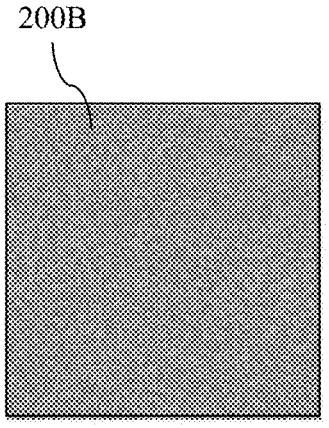
FIG. 2B is a grayscale version of a photograph depicting the exemplary all-green raw image sent to a display of FIG. 2A, as displayed to an observer, and uncorrected according to exemplary embodiments of the present invention.

FIG. 2B is a grayscale version of a photograph (200B) depicting the exemplary all-green raw image sent to a display of FIG. 2A, as displayed to an observer, and uncorrected according to exemplary embodiments of the present invention.

Figure 2C:
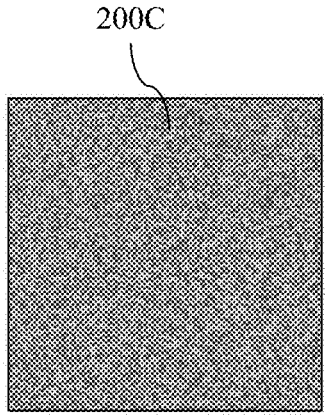
FIG. 2C is a photograph depicting exemplary pixel-by-pixel correction factors according to aspects of the present invention.

FIG. 2C is a photograph (200C) depicting exemplary pixel-by-pixel correction factors according to aspects of the present invention.

Figure 2D:
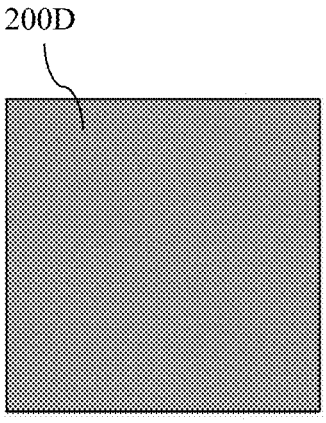
FIG. 2D is a grayscale version of a photograph depicting pre-corrected imagery according to aspects of the present invention, corresponding to the image shown in FIG. 2B, as sent to an exemplary display.

FIG. 2D is a grayscale version of a photograph (200D) depicting pre-corrected imagery according to aspects of the present invention, corresponding to the image shown in FIG. 2B, as sent to an exemplary display.

Figure 2E:
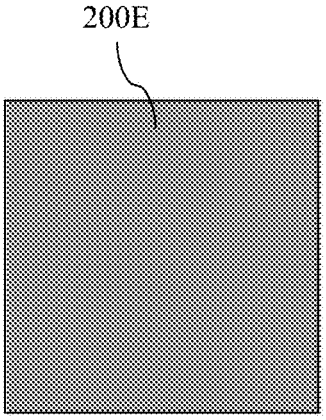
FIG. 2E is a grayscale version of a photograph depicting an exemplary final image shown to an observer, according to aspects of the present invention, corresponding to the image depicted in FIG. 2D.

FIG. 2E is a grayscale version of a photograph (200E) depicting an exemplary final image shown to an observer, according to aspects of the present invention, corresponding to the image depicted in FIG. 2D.

Figure 3:
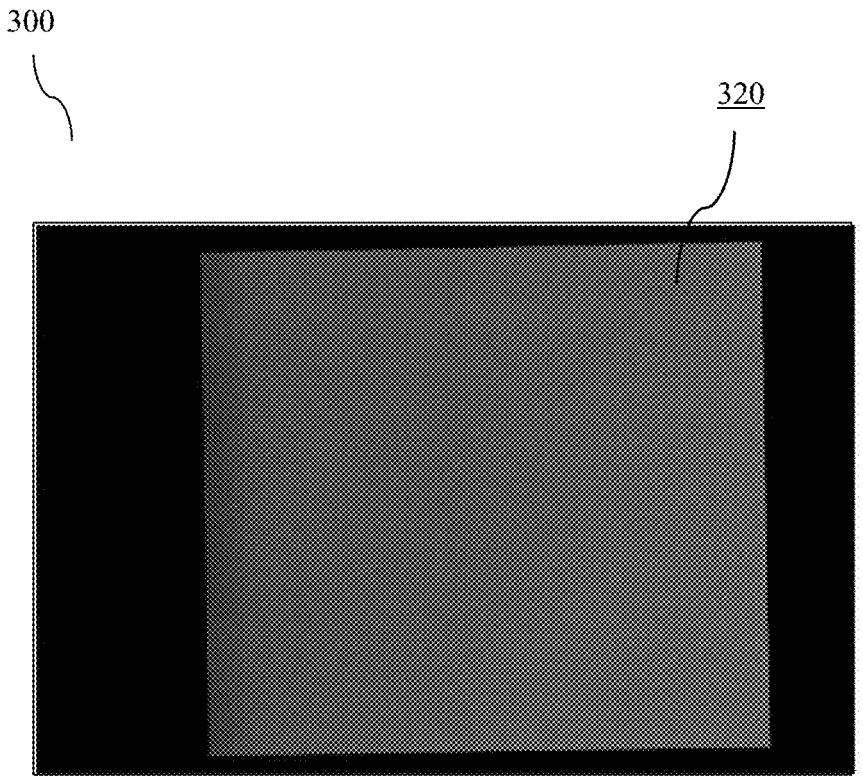
FIG. 3 is a grayscale version of a photograph depicting an exemplary image capture on a display panel of a constant green image with resolution sufficient to achieve an energy estimate for each sub-pixel according to aspects of the present invention.

FIG. 3 is a grayscale version of a photograph (300) depicting an exemplary image capture on a display panel (320) of a constant green image with resolution sufficient to achieve an energy estimate for each sub-pixel according to aspects of the present invention.

Figure 4:
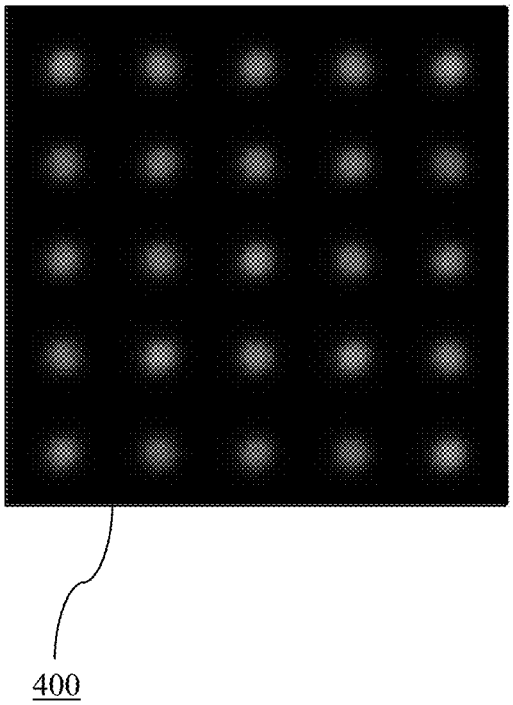
FIG. 4 is a zoomed-in grayscale version of a photograph (approximate zoom factor=1000) of a portion of the image depicted in FIG. 3, with only the green channel illuminated, comprising a 5-by-5 pixel region with visible sub-pixels.

FIG. 4 is a zoomed-in grayscale version of a photograph (400) (approximate zoom factor=1000) of a portion of the image depicted in FIG. 3, with only the green channel illuminated, comprising a 5-by-5 pixel region with visible sub-pixels.

If a camera is utilized which does not have a resolution sufficient to maintain this resolution across the full panel, sub-regions may be imaged in certain embodiments and then the resulting data sets may be smoothly blended.

Alternatively, for some display applications such as HMDs, it is not always necessary to image the full visual field. For example, measuring and correcting only the central field of view is often sufficient in certain embodiments, provided the correction layer smoothly blends to 'no correction' at the periphery of the corrected area (rather than the alternative of cutting off correction abruptly). This may be accomplished in certain embodiments by smoothly blending the per-pixel correction factors (described in more detail later) with a 'null value' towards the periphery.

Figure 5A:
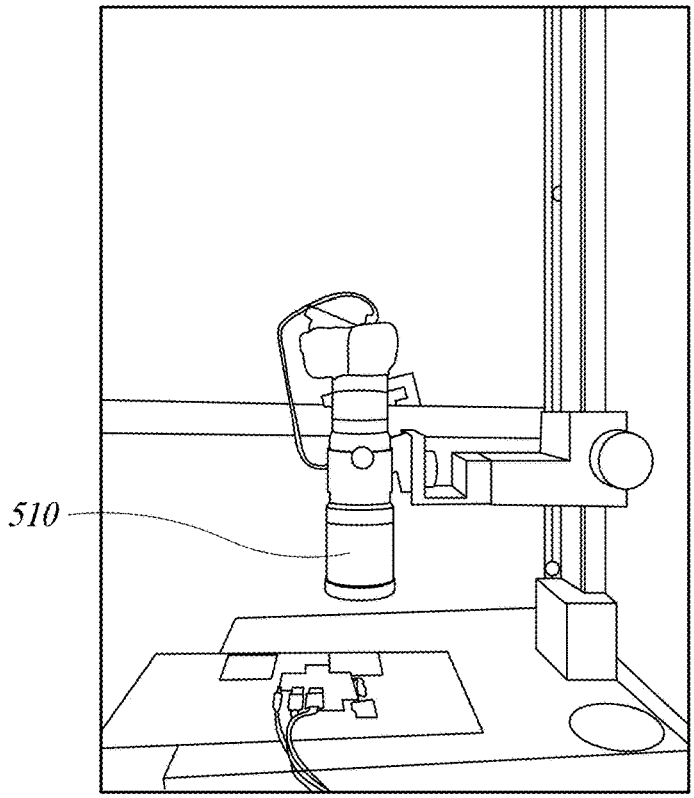
FIGS. 5A and 5B are photographs depicting aspects of an exemplary image capture system and configuration according to aspects of the present invention.
Figure 5B:
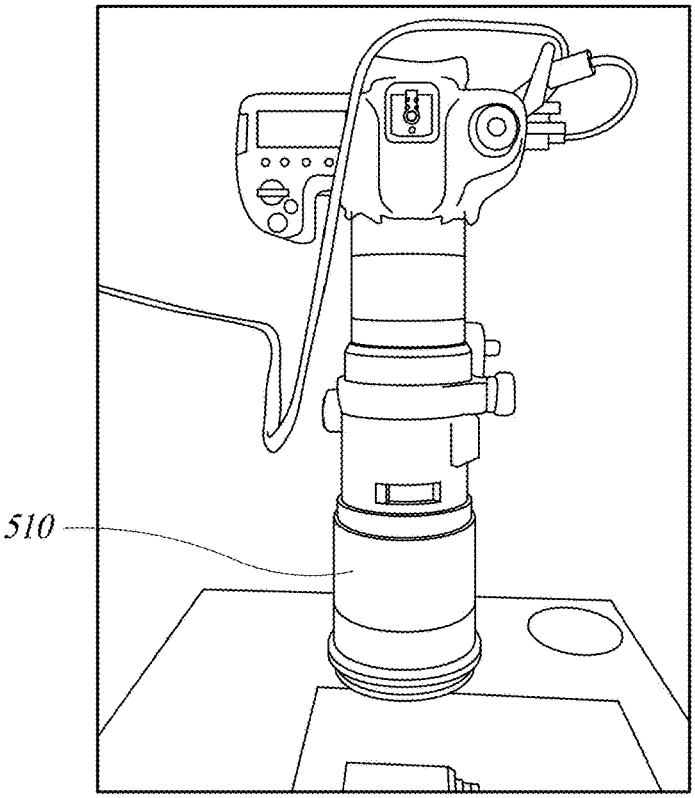

FIGS. 5A and 5B are photographs depicting aspects of an exemplary image capture system and configuration according to aspects of the present invention.

Figure 6:
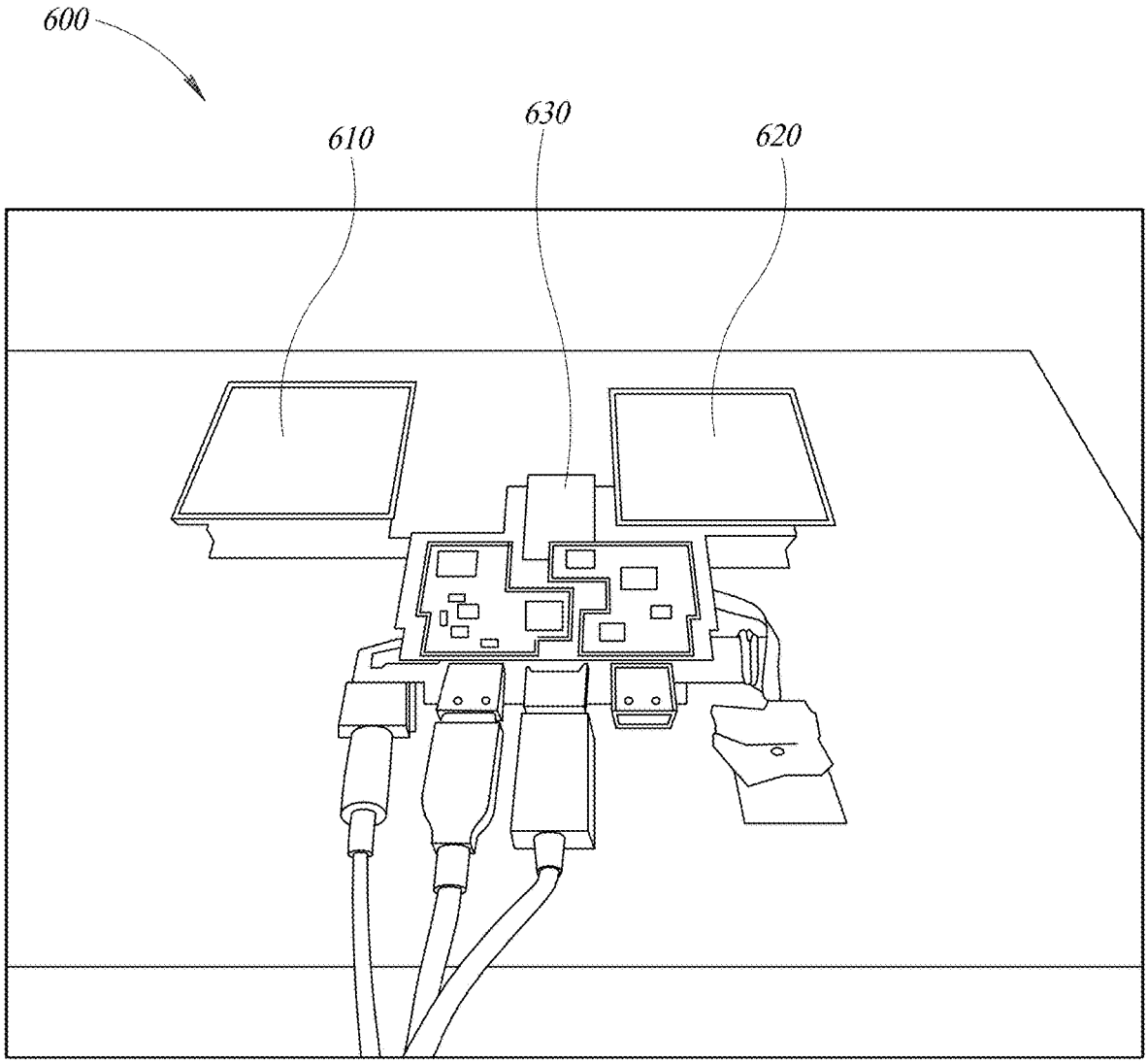
FIG. 6 depicts two exemplary display panels (610, 620) being driven by customized electronics (630) according to aspects of the present invention to simulate a head-mounted-display configuration.

In one exemplary display measurement system embodiment (as shown in FIGS. 5A and 5B), the following equipment may be used: a Canon 5Ds digital SLR camera, a 180 mm macro photograph lens (510), and a rigid macro stand. Drive electronics are also included (630, shown in FIG. 6), which drive the displays (610, 620) in a manner that matches HIVID usage (i.e., low persistence, 90 Hz or 120 Hz frame rate). In display production environments, measurements are typically taken in a dust-free and light-blocking enclosure in certain embodiments.

In order to accurately predict the placement for each of millions of sub-pixels, the imaging system (lens) must be spatially calibrated beyond the sub-pixel level in certain embodiments. This correction is typically dependent upon factors such as camera lens model and live focus, fstop settings.

Prior to taking a color measurement in certain embodiments, geometric lens eccentricities are accounted for by placing a known grid pattern on the display. This is a common technique used by ordinarily skilled artisans in the field of in computer vision, although the precision of requirements according to certain implementations of the present invention go beyond typical uses. Post-calibration, the geometric accuracy of the lens and imaging system must be correct beyond the sub-pixel level of the imaging device in certain embodiments. That is, for a five-by-five per sub-pixel imaging of the display raster in such embodiments, the overall geometric distortion must be much less than one output pixel, equivalent to less than one-fifth of the spacing between display sub-pixels.

Figure 7:
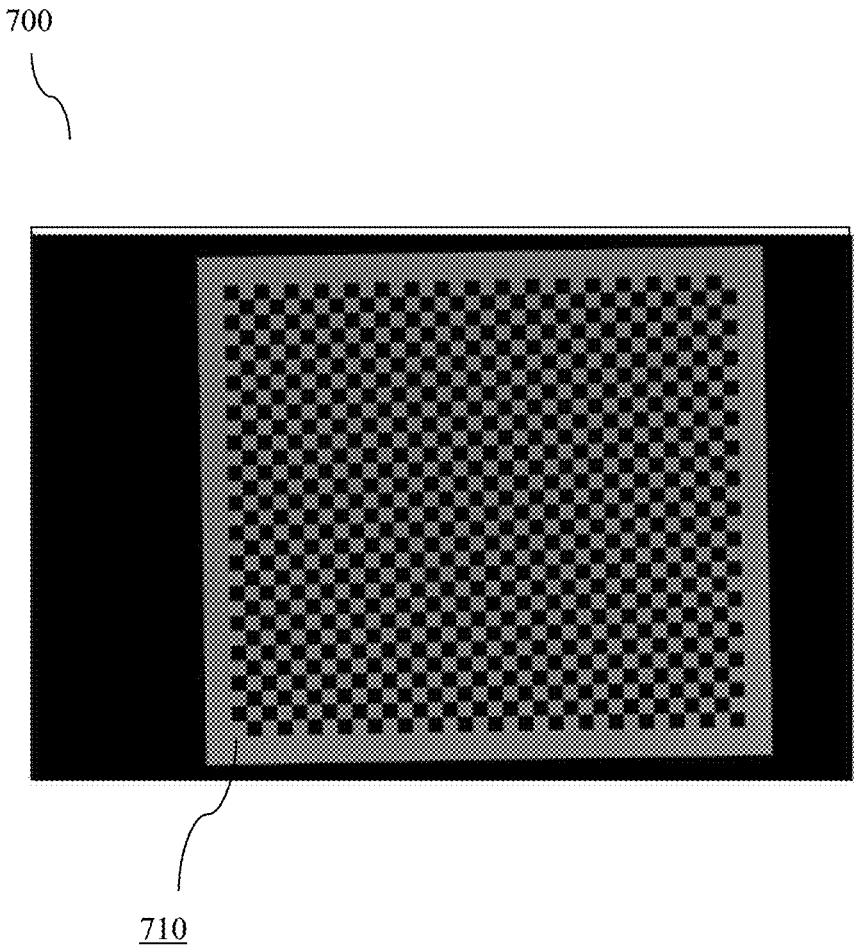
FIG. 7 depicts a grid pattern shown on a display panel under test for use during calibration and to facilitate solving for geometric lens eccentricities according to aspects of the present invention.

FIG. 7 depicts a grid pattern (710) shown on a display panel under test for use during calibration and to facilitate solving for geometric lens eccentricities according to aspects of the present invention.

Next, in certain embodiments a black image is captured to determine the dark field response of the camera.

Finally, an image suitable for characterizing the per-pixel response is displayed. In certain embodiments, this is typically a monochrome image of constant color.

All images are captured using 'camera raw' processing in certain embodiments, which preserves their photometric linearity.

Figure 8:
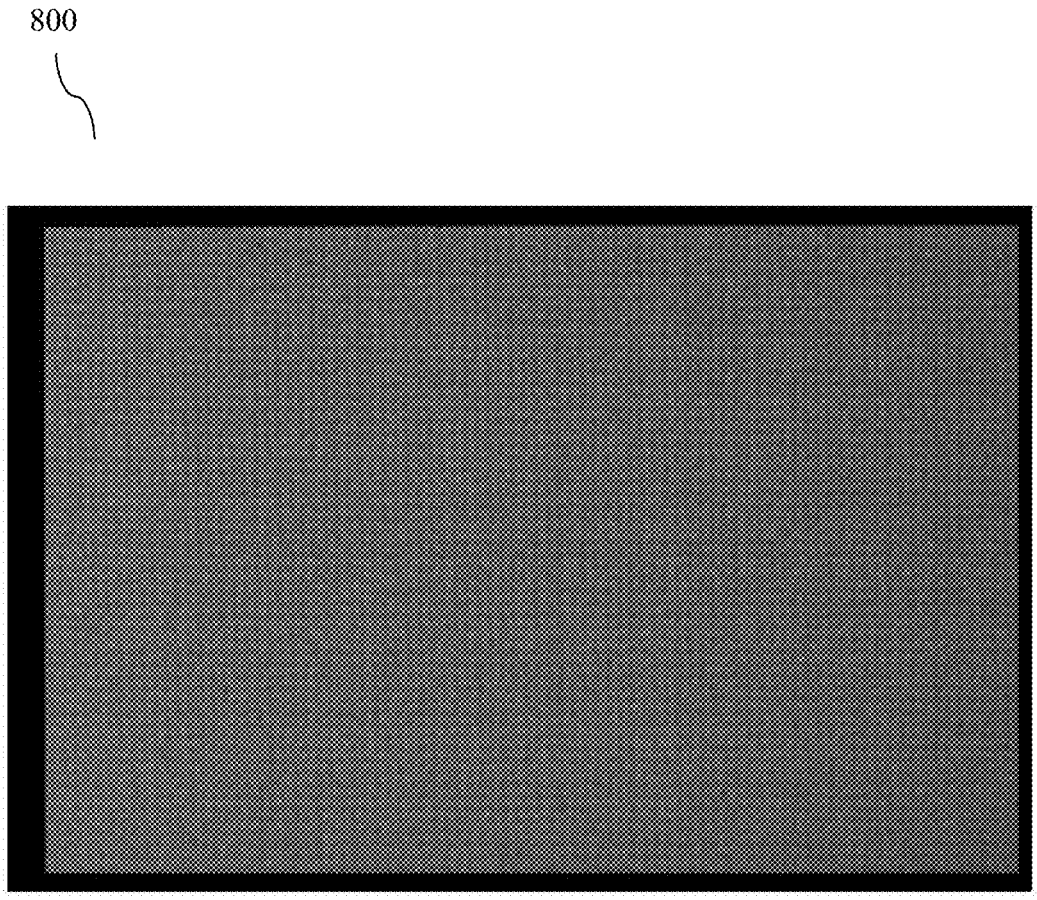
FIG. 8 is a grayscale version of a photograph depicting a captured image according to aspects of the present invention, after dark field subtraction and lens undistortion steps used in certain embodiments.

The dark field is then subtracted from the captured image in certain embodiments, and is then unwarped by the lens solution. FIG. 8 is a grayscale version of a photograph depicting a captured image according to aspects of the present invention (800), after dark field subtraction and lens undistortion steps used in certain embodiments.

A deconvolution kernel may be applied in certain embodiments, which removes local flares in the imaging chain. This flare compensation can be validated using an image which measures the "PFS" (point-spread function). Typically, a single point pixel is illuminated in an otherwise constant valued region to compute this value.

Figure 9:
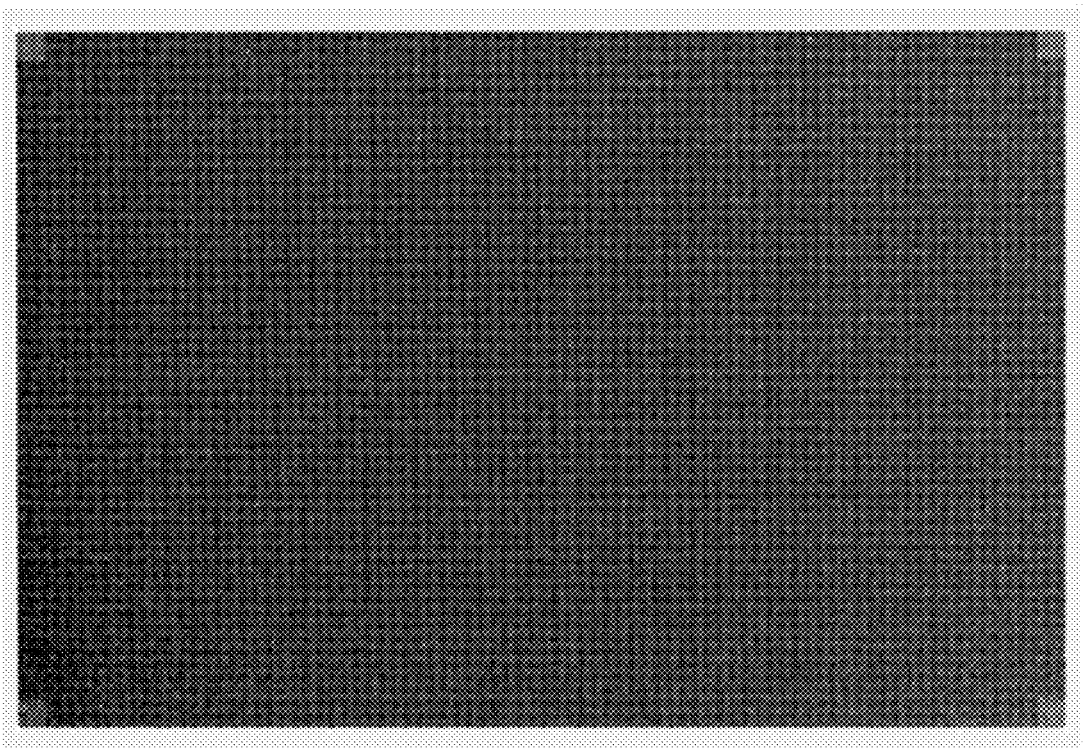
FIG. 9 is a grayscale version of a photograph depicting corner-detection steps in a captured image according to aspects of the present invention.

In certain embodiments, the pixel corners for the captured rectangular area are detected, and a four-corner perspective warp creates an axis-aligned representation, where each sub-pixel has a consistent size and alignment. FIG. 9 is a photograph depicting corner-detection steps in a captured image (900) according to aspects of the present invention.

Figure 10:
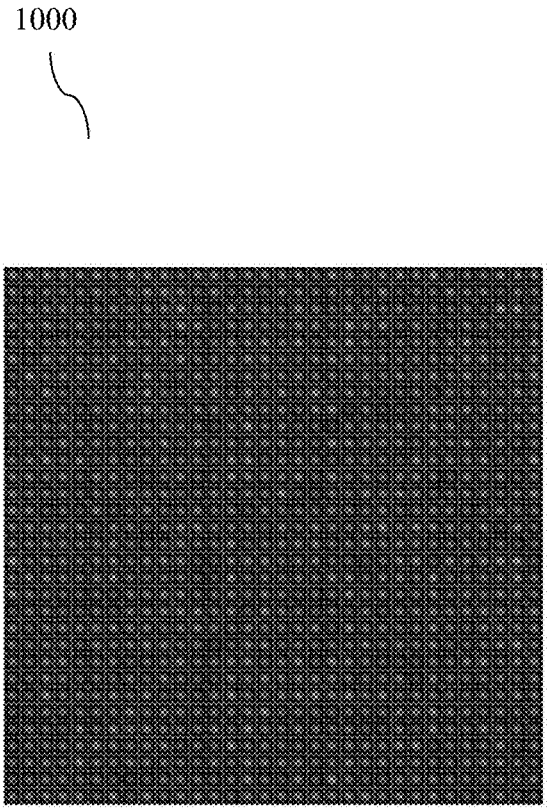
FIG. 10 is a grayscale version of a photograph depicting an exemplary 32-by-32 pixel inset area in a captured image of a display panel under test after rectilinear alignment according to aspects of the present invention.

FIG. 10 is a grayscale version of a photograph (1000) depicting an exemplary 32-by-32 pixel inset area in a captured image of a display panel under test after rectilinear alignment according to aspects of the present invention.

Each sub-pixel is centered in each box in certain embodiments, allowing for accurate energy estimation, where each box is the area integrated for each sub-pixel. Each sub-pixel typically has a different intensity, as shown in FIG. 11; this is the effect that is measured and/or corrected in whole or in part according to aspects of the present invention.

Finally, according to certain embodiment, the energy for each pixel is calculated by summing all values in each pixel area.

Figure 11:
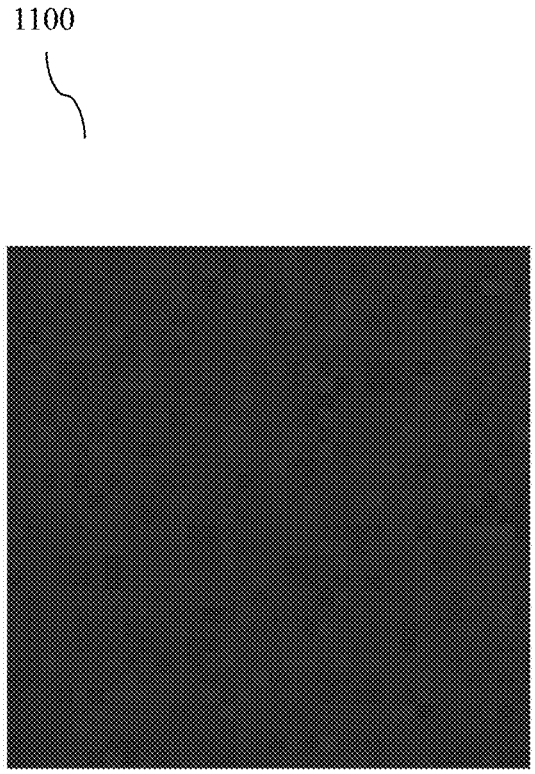
FIG. 11 graphically depicts pixel-by-pixel energy emission in a portion of an exemplary display panel under test according to aspects of the present invention.

FIG. 11 graphically depicts pixel-by-pixel energy emission in a portion of an exemplary display panel under test (1100) according to aspects of the present invention.

This process is typically highly sensitive to dust landing on the panel during image acquisition. If dust or fibers land on the display, they will absorb and/or scatter some light so the overlapping pixels will be incorrectly measured as dim. When compensation is applied, these pixels will have strong positive gain factors applied and will stand out as objectionable "overbright" pixels. To compensate for dust, multiple images of the panel may be taken in certain embodiments, with a blast of air (or other cleaning process) effected between each image capture. The energy estimates are computed individually for each captured image, and then merged using the max( ) operator for each pixel. As dust and other particulates can typically only make pixels dimmer (not brighter) during capture, as long as the dust moves between subsequent captures, its impact may be removed.

Summary of capture process in certain embodiments:

Align and lock camera to proper panel position, including focus and exposure

Capture grid pattern (monochrome) and solve for lens geometric characteristics

Display all-black image, to capture dark field

Display target flat-field colors (monochrome) and capture pixels in photometric linear data (camera raw)

Subtract dark field

Apply deconvolution to account for imaging system PSF

Unwarp by lens solution

Detect pixel corners for visual field for all four corners

Use four-corner perspective warp to synthesize idealized, axis-aligned rectilinear grid. Each sub-pixel in the display should correspond to a known, axis aligned box of constant size in the aligned output image.

Sum energy in each box corresponding to a sub-pixel.

For estimates robust to dust, repeat N times with a cleaning/air blast between captures. Merge captures using the maximum value estimate for each sub-pixel across all captures.

Correction Factor Modeling

For each display panel, based on the correction model, a set of global and per-pixel correction factors may be computed in certain embodiments. Iterative and non-iterative approaches to computing the correction factors may be implemented, as well as variations and/or combinations of these approaches, depending on the particular requirements of each implementation.

Non-Iterative Approach

The following model may be used as the starting point, which accounts for more than 90% of the mura effect in OLED panels. (For other display technologies, alternative formulations may be employed to compactly represent the artifact, as known to those of ordinary skill in the art).

$$CCV(x,y)=ICV(x,y)+PPD(x,y)$$

where:

CCV: Corrected code value in the device native gamma encoding

ICV: Input code value in the device native gamma encoding

PPD: per-pixel delta (x,y) denotes that the quantity varies as a function of the output pixel location (x,y) in display space.

During final playback (applying the correction factors in real-time to novel imagery), it may be convenient in certain embodiments to encode the per-pixel delta maximizing the coding space by pulling out the min and max values into global constants.

$$PPD(x,y)=PPV(x,y)*CG+CO$$

$$CCV(x,y)=ICV(x,y)+PPD(x,y)$$

where:

CCV: Corrected code value in the device native gamma encoding

ICV: Input code value in the device native gamma encoding

PPV: per-pixel value encoded with limited bits

PPD: per-pixel delta

CG: correction gain

CO: correction offset

Gain/offset: global values used to interpret per-pixel deltas

It should be noted that despite the simplicity of the above mathematical formulation (i.e., adding a constant per-pixel delta value in the device's native coding space), it is counterintuitive that a display technology would behave in this manner. Indeed, although the a more intuitive model for the relevant behavior may be a per-pixel correction factor with a linear gain operation. (e.g., cause one pixel to emit 20% more light, cause another one to be 5% dimmer, etc.), when formulated in this intuitive manner the amount of gain varies as a function of the input code value. After significant investigation and experimentation, it was determined that these higher order terms canceled out, resulting in simplified formulation used in certain embodiments that is described herein.

It has been determined according to aspects of the present invention that that the mura effect can be cancelled out for OLED displays with an additive offset applied in the device's gamma encoding.

Computing the Per-Pixel Deltas

As an additive offset is modeled, a representative code value is selected and the energy estimate is measured, per pixel, for a flat-field image. Specifically for the case of OLEDs in certain embodiments, code value 51 (out of 255) may be selected. This value is dim enough that a fixed additive offset has a high signal-to-noise ratio, but it is bright enough that exposure times are not prohibitive. Of course, different implementations may be better suited to different representative code values.

$$PPD=TCV-pow(LPE(x,y)/LPELA(x,y)*pow(TCV, DG),1.0/DG)$$

where:

PPD: per-pixel delta

TCV: target code-value (that sent to display during measurement)

LPE: linear pixel energy

LPELA: linear pixel energy, local area average (local energy average for surrounding neighborhood, often center/Gaussian weighted).

DG: display gamma (typically a constant=2.2)

The above equation models the question: assuming an idealized gamma transfer function for the display—"pow(x, gamma)"—what input code value models the linear light we have measured? Dividing the linear pixel energy by a local average allows for robustly computing how this pixel compares an ideal, in a manner robust to global lens capture effects. The size of the local average window is tailored to the display technology being measured in certain embodiments.

One may also replace the sub-expression "pow(x, gamma)" in certain embodiments with a more accurate display gamma characterization:

$$PPD=TCV-inv_display_response(LPE(x,y)/LPELA(x,y)*display_response(TCV))$$

Alternative formations also exist based on different mathematical assumptions of the display response, to compute the per-pixel deltas corrections from the measured energy estimates.

Assuming a locally linear and symmetric display response:

$$PPD=log\ (LPE(x,y)/LPELA(x,y))*display_response_constant$$

Assuming an anti-symmetric display response (where dim pixels must be driven with proportionally larger gain to make up the difference in response):

$$PPD=TCV+pow(LPELA(x,y)/LPE(x,y)*pow(TCV, DG),1.0/DG)$$

All equations listed above yield similar, though not identical, correction factors. Other formulations are known to exist which also approximate the per-pixel deltas, though with decreasing accuracy when modeling OLED technology. In general, the preferred technique is the one that minimizes the mura appearance, post-correction, as judged by a human observer.

Iterative Approach

While a single capture can correct for more than 90% of the effect, there are still lingering inaccuracies that can be accounted for in certain embodiments. In the iterative approach, we first solve for the constant per-pixel delta in certain embodiments as stated above. But then the process may be augmented in certain embodiments by sending a corrected flat-field image to the display and recording the residual uncorrected deltas. This residual is measured for multiple input code values in certain embodiments, and then the per-pixel residuals are calculated and applied by interpolating the recorded data sets.

$$CCV(x,y)=ICV(x,y)+PPD(x,y)+PPR(ICV,x,y)$$

where:

CCV: Corrected code value in the device native gamma encoding

ICV: Input code value in the device native gamma encoding

PPD: per-pixel delta

PPR: per-pixel residual, which is a function of the input code value

As the per-pixel residuals are much smaller than the per-pixel deltas, multiple residuals can be efficiently stored in a similar amount of space to the original per-pixel factor.

Over the lifetime of a display panel, the mura artifacts often change in intensity. This may be accounted for in certain embodiments by manipulating the correction gain factor to apply more, or less, of the correction as needed.

While display output is quantized to integral output values of light (such as 256 steps yielded by an 8-bit input) the per-pixel intensity variation may be modeled in certain embodiments at a greater degree of precision. By storing the per-pixel deltas with greater precision than the display, it is possible to globally recreate output luminance values with greater precision than the number of steps in the input (i.e., each individual pixel may only have 256 addressable steps, but local regions on average may have many more discrete output levels in certain embodiments).

Leveraging per-pixel display intensity variation to reduce banding artifacts is as interesting transmission technology, independent of the mura display artifact. For example, in a system with a high bit-precision image synthesis, a "mura-free" high bit-precision display, but a low bit-depth transmission link, one may introduce artificial pixel variation in the display to reduce the appearance of banding.

Synthetic pixel variation patterns can be created which have more compact representations and lower sampling discrepancy than the natural mura seen on OLED displays. One formulation is to use a tileable noise pattern, with a uniform sampling over the luma domain of +/−0.5 code values. The noise tiling is a jittered stratified sampling or blue noise in certain embodiments, such that pixel values are unlikely to have an offset similar to their neighbors. By making the transmission source aware of the display's pixel variation algorithm, the appropriate quantization per-pixel may be applied such that banding appearance is reduced.

A tileable noise pattern may also be created that varies over time to further reduce banding artifacts, though in such a system the image synthesis in certain embodiments needs to encode and transmit which 'frame' of noise to apply to the pixel variation.

Another advancement in certain embodiments is to bias the uniform sampling as a function of code value, such that clipped values are not introduced. For an exemplary 8-bit transmission link, code value 0 presumes uniform random biases in the range of [0.0, 1.0], for an intermediate code value (128), [−0.5, 0.5] is selected, and for code value 255, [−1.0, 0.0] is used.

In certain HMD-related embodiments, mura correction processing in accordance with aspects of the present invention is performed host-side on the graphics processing unit ("GPU"). However, depending on the requirements of each particular implementation, such processing may be effected in silicon, in the headset itself, on a tether, or in the display panel electronics, for example. Such alternative implementations may provide greater image compressibility, which is important in situations involving limited link bandwidths (e.g., wireless systems).

While the above description contains many specifics and certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art, as mentioned above. The invention includes any combination or subcombination of the elements from the different species and/or embodiments disclosed herein.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, including U.S. Provisional App. No. 62/207,091 filed on Aug. 19, 2015 and U.S. application Ser. No. 15/239,982 filed on Aug. 18, 2016, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method for reducing the appearance of visual artifacts caused by pixel-by-pixel energy emission variations exhibited in at least a portion of a display panel comprising a plurality of pixels, the method comprising:

causing at least a subset of the pixels in the at least a portion of the display panel to emit light;

sensing, via an optical sensor, the light emitted by each of the pixels in the at least a portion of the display panel;

estimating energy emitted for each of the pixels based at least in part on the sensing of the light emitted by each of the pixels in the at least a portion of the display panel;

computing a set of per-pixel correction factors based at least in part on a correction model and the estimated energy emitted for each of the pixels, wherein the correction model comprises, for each per-pixel correction factor, an intermediate per-pixel result that comprises an offset applied in a native gamma encoding of the display panel to an input code value corresponding to the pixel to which the per-pixel correction factor relates, and a per-pixel residual added to the intermediate per-pixel result that is a function of said input code value; and storing the computed set of per-pixel correction factors in at least one nontransitory processor-readable storage medium.

2. The method of claim 1, further comprising applying the correction factors in real-time to image data being transmitted to the at least a portion of the display panel.

3. The method of claim 1 wherein causing at least a subset of the pixels in the at least a portion of the display panel to emit light comprises causing each of the pixels in the at least a portion of the display panel of a single color to emit light.

4. The method of claim 1 wherein causing at least a subset of the pixels in the at least a portion of the display panel to emit light comprises causing each of the pixels of a single color in the entire display panel to emit light, and sensing the light emitted by each of the pixels comprises sensing the light emitted by each of the pixels in the entire display panel.

5. The method of claim 1 wherein causing at least a subset of the pixels in the at least a portion of the display panel to emit light comprises causing each of the pixels of a single color in a central region of the display panel to emit light, and sensing the light emitted by each of the pixels comprises sensing the light emitted by each of the pixels in the central region of the display panel.

6. The method of claim 1, further comprising:

causing the at least a subset of the pixels in the at least a portion of the display panel to not emit light; and sensing, via the optical sensor, the at least a portion of the display panel while the at least a subset of the pixels are not emitting light to obtain a dark field image, wherein estimating energy emitted for each of the pixels comprises subtracting the dark field image from the sensed light emitted by each of the pixels.

7. A method for reducing the appearance of visual artifacts caused by pixel-by-pixel energy emission variations exhibited in at least a portion of a display panel comprising a plurality of pixels, the method comprising:

causing at least a subset of the pixels in the at least a portion of the display panel to emit light;

sensing, via an optical sensor, the light emitted by each of the pixels in the at least a portion of the display panel;

estimating energy emitted for each of the pixels based at least in part on the sensing of the light emitted by each of the pixels in the at least a portion of the display panel;

computing a set of per-pixel correction factors based at least in part on a correction model and the estimated energy emitted for each of the pixels; and storing the computed set of per-pixel correction factors in at least one nontransitory processor-readable storage medium, wherein causing at least a subset of the pixels in the at least a portion of the display panel to emit light comprises causing each of the pixels of a single color in a central region of the display panel to emit light, and sensing the light emitted by each of the pixels comprises sensing the light emitted by each of the pixels in the central region of the display panel, and computing a set of per-pixel correction factors comprises computing a set of per-pixel correction factors for the pixels in the central region, and smoothly blending the per-pixel correction factors to provide no correction towards the periphery of the display panel.

8. A method for reducing the appearance of visual artifacts caused by pixel-by-pixel energy emission variations exhibited in at least a portion of a display panel comprising a plurality of pixels, the method comprising:

causing at least a subset of the pixels in the at least a portion of the display panel to emit light that forms a known grid pattern on the display panel;

sensing, via an optical sensor, the light emitted by each of the pixels in the grid pattern;

analyzing the sensed grid pattern to solve for geometric lens eccentricities of a lens associated with the optical sensor;

estimating energy emitted for each of the pixels based at least in part on the sensing of the light emitted by each of the pixels in the at least a portion of the display panel, wherein estimating energy emitted for each of the pixels comprises estimating energy emitted for each of the pixels based at least in part on the determined geometric lens eccentricities of the lens;

computing a set of per-pixel correction factors based at least in part on a correction model and the estimated energy emitted for each of the pixels; and storing the computed set of per-pixel correction factors in at least one nontransitory processor-readable storage medium.

9. A method for reducing the appearance of visual artifacts caused by pixel-by-pixel energy emission variations exhibited in at least a portion of a display panel comprising a plurality of pixels, the method comprising:

causing at least a subset of the pixels in the at least a portion of the display panel to emit light;

sensing, via an optical sensor, the light emitted by each of the pixels in the at least a portion of the display panel;

estimating energy emitted for each of the pixels based at least in part on the sensing of the light emitted by each of the pixels in the at least a portion of the display panel, wherein estimating energy emitted for each of the pixels based comprises applying a deconvolution kernel to the sensed light emitted by each of the pixels to remove local flares;

computing a set of per-pixel correction factors based at least in part on a correction model and the estimated energy emitted for each of the pixels; and storing the computed set of per-pixel correction factors in at least one nontransitory processor-readable storage medium.

10. A method for reducing the appearance of visual artifacts caused by pixel-by-pixel energy emission variations exhibited in at least a portion of a display panel comprising a plurality of pixels, the method comprising:

for each of a plurality of iterations, cleaning the display panel;

causing the at least a subset of the pixels in at least a portion of the display panel to emit light;

sensing, via an optical sensor, the light emitted by each of the pixels in the at least a portion of the display panel;

estimating energy emitted for each of the pixels based at least in part on the sensing of the light emitted by each of the pixels in the at least a portion of the display panel; and for each of the pixels, merging the plurality of energy estimates to compute a single energy estimate for the pixel;

computing a set of per-pixel correction factors based at least in part on a correction model and the energy estimate for each of the pixels; and storing the computed set of per-pixel correction factors in at least one nontransitory processor-readable storage medium.

11. The method of claim 10 wherein merging the plurality of energy estimates comprises determining a maximum value of the plurality of energy estimates, and selecting the maximum value as the single energy estimate for the pixel.

12. An apparatus for reducing the appearance of visual artifacts caused by pixel-by-pixel energy emission variations exhibited in at least a portion of a display panel, the apparatus comprising:

a camera;

at least one nontransitory processor-readable storage medium that stores at least one of instructions or data;

at least one processor operatively coupled to the camera, the display panel, and the at least one nontransitory processor-readable storage medium, in operation, the at least one processor:

causes pixels in the at least a portion of the display panel to not emit light;

causes the camera to capture a dark field image of the portion of the display panel while the pixels in the at least a portion of the display panel are not emitting light;

causes pixels of a single color in the at least a portion of the display panel to emit light;

causes the camera to capture a lighted image of the at least a portion of the display panel while the pixels of a single color in the at least a portion of the display panel emit light;

estimates energy emitted for each of the pixels based at least in part on the captured image, wherein to estimate the energy, the at least one processor subtracts the dark field image from the lighted image;

computes a set of per-pixel correction factors based at least in part on a correction model and the estimated energy emitted for each of the pixels, wherein the correction model comprises, for each per-pixel correction factor, an intermediate per-pixel result that comprises an offset applied in a native gamma encoding of the display panel to an input code value corresponding to the pixel to which the per-pixel correction factor relates, and a per-pixel residual added to the intermediate per-pixel result that is a function of said input code value; and stores the computed set of per-pixel correction factors in the at least one nontransitory processor-readable storage medium.

13. The apparatus of claim 12, further comprising the display panel, wherein, in operation, the at least one processor applies the correction factors in real-time to image data being transmitted to the at least a portion of the display panel.

14. The apparatus of claim 13 wherein the display panel comprises a display panel of a head-mounted display (HMD) device.

15. The apparatus of claim 13 wherein the display panel comprises a liquid crystal display or an organic light emitting diode display.

* * * * *